US006740014B2

(12) United States Patent
Tsai

(10) Patent No.: US 6,740,014 B2
(45) Date of Patent: May 25, 2004

(54) BODY EXERCISER HAVING A RESET ADJUSTMENT FUNCTION

(76) Inventor: Jao Hsing Tsai, 1Fl., No. 10, Lane 136, Junghe Rd., Hsinchu (TW)

( * ) Notice: Subject to any disclaimer, the term of this patent is extended or adjusted under 35 U.S.C. 154(b) by 20 days.

(21) Appl. No.: 10/254,267

(22) Filed: Sep. 25, 2002

(65) Prior Publication Data

US 2004/0058789 A1 Mar. 25, 2004

(51) Int. Cl.[7] ..... A63B 21/02
(52) U.S. Cl. ..... 482/115
(58) Field of Search ..... 482/115, 116, 482/118–120, 126, 127, 114, 51, 128

(56) References Cited

U.S. PATENT DOCUMENTS 2,959,414 A * 11/1960 Saltz ..... 482/127
3,610,617 A * 10/1971 Hepburn ..... 482/116
4,235,439 A * 11/1980 De Donno ..... 482/116
4,625,961 A * 12/1986 Brand ..... 482/116
4,944,511 A * 7/1990 Francis ..... 482/123

* cited by examiner

*Primary Examiner*—Stephen R. Crow
(74) *Attorney, Agent, or Firm*—Alan Kamrath

(57) ABSTRACT

A body exerciser includes a main body structure, a gravity mechanism, and a restoring mechanism. Thus, the body exerciser may be used to exercise the user's two hands, thereby achieving an exercising effect. In addition, by operation of the restoring mechanism, each of the two pull cords may be scrolled on each of the reels actually, thereby preventing the two pull cords from becoming loosened.

8 Claims, 6 Drawing Sheets

BODY EXERCISER HAVING A RESET ADJUSTMENT FUNCTION

BACKGROUND OF THE INVENTION

1. Field of the Invention

The present invention relates to a body exerciser having a reset adjustment function, and more particularly to a body exerciser having a reset adjustment function, wherein by operation of the restoring mechanism, each of the two pull cords may be scrolled on each of the reels actually, thereby preventing the two pull cords from becoming loosened.

2. Description of the Related Art

A conventional body exerciser in accordance with the prior art shown in FIG. 6 comprises a flat plate 40, a casing 41 secured on the flat plate 40, two spindles 42 mounted on the casing 41, two single-direction bearings 43 each mounted on a respective one of the two spindles 42, two reels 44 each mounted on a respective one of the two single-direction bearings 43, two pull cords 45 each mounted around an outer wall of a respective one of the two reels 44, two restoring springs 46 each mounted on an inner wall of a respective one of the two reels 44 and each having a fixing end 461 secured on the casing 41 and a free end 462 secured on the respective reel 44, two friction wheels 50 each secured on a respective one of the two spindles 42, a plate 51 secured on the flat plate 40, a positioning frame 52 secured between the plate 51 and the casing 41, an adjusting column 53 extended through the positioning frame 52, an adjusting knob 54 secured on a top of the adjusting column 53, a displacement frame 55 screwed on a bottom of the adjusting column 53, an elastic member 56 urged between the positioning frame 52 and the displacement frame 55, and two friction pieces 57 secured on the displacement frame 55 and enclosed around a periphery of a respective one of the two friction wheels 50.

In operation, the user's two hands may pull the two pull cords 45 upward, so as to drive each of the two reels 44 and each of the two friction wheels 50 to rotate. At this time, each of the two friction wheels 50 is subjected to the gravity load of each of the two friction pieces 57, and is subjected to the elastic compression of each of the two restoring springs 46, so that the user has to withstand the pulling loads of different extents, thereby achieving the purpose of exercising the user's hands.

However, the two pull cords 45 are pulled and loosened successively, so that each of the two restoring springs 46 easily produces an elastic fatigue, so that rotation of each of the reels 44 is not complete, and each of the two pull cords 45 cannot be scrolled by the respective reel 44 completely, thereby causing inconvenience to the user.

SUMMARY OF THE INVENTION

The present invention has arisen to mitigate and/or obviate the disadvantage of the conventional body exerciser.

The primary objective of the present invention is to provide a body exerciser having a reset adjustment function, wherein the body exerciser may be used to exercise the user's two hands, thereby achieving an exercising effect.

Another objective of the present invention is to provide a body exerciser having a reset adjustment function, wherein each of the two pull cords may be scrolled on each of the reels actually, thereby preventing the two pull cords from becoming loosened.

In accordance with the present invention, there is provided a body exerciser, comprising a main body structure, a gravity mechanism, and a restoring mechanism, wherein:

the main body structure includes a flat plate, a casing secured on a top face of the flat plate, two spindles rotatably mounted on the casing, two single-direction bearings each mounted on a respective one of the two spindles, two reels each mounted on a respective one of the two single-direction bearings and each having an inner wall formed with a plurality of slits, two pull cords each having a first end mounted around an outer wall of a respective one of the two reels and a second end extended outward from the casing, and two restoring springs each mounted on the inner wall of a respective one of the two reels and each having a fixing end secured in one of the slits of the respective reel;

the gravity mechanism includes two friction wheels each secured on a respective one of the two spindles of the main body structure to rotate therewith, a first plate secured on the top face of the flat plate for supporting each of the two spindles, a positioning frame secured between the first plate and the casing, an adjusting column extended through a top face of the positioning frame, an adjusting knob secured on a top of the adjusting column for rotating the adjusting column, a displacement frame screwed on a bottom of the adjusting column, an elastic member urged between the positioning frame and the displacement frame, and two friction pieces secured on the displacement frame and enclosed around a periphery of a respective one of the two friction wheels; and the restoring mechanism includes a second plate secured on a side edge of the casing, the second plate of the restoring mechanism is formed with two through holes and a plurality of positioning holes arranged around a periphery of each of the two through holes in an annular manner, the restoring mechanism further includes two drive shafts each passed through a respective one of the two through holes of the second plate, two rotation knobs each secured on a first end of a respective one of the two drive shafts for rotating it, two drive gears each secured on and rotated by a second end of a respective one of the two drive shafts, and two driven gears each mounted on a respective one of the two spindles and each meshing with a respective one of the two drive gears, each of the two driven gears has one side provided with a positioning pin which is secured on a free end of a respective one of the two restoring springs, each of the two rotation knobs has one side provided with a plurality of protruding stubs each positioned in a respective one of the positioning holes of the second plate.

Further benefits and advantages of the present invention will become apparent after a careful reading of the detailed description with appropriate reference to the accompanying drawings.

DETAILED DESCRIPTION OF THE INVENTION

Figure 1:
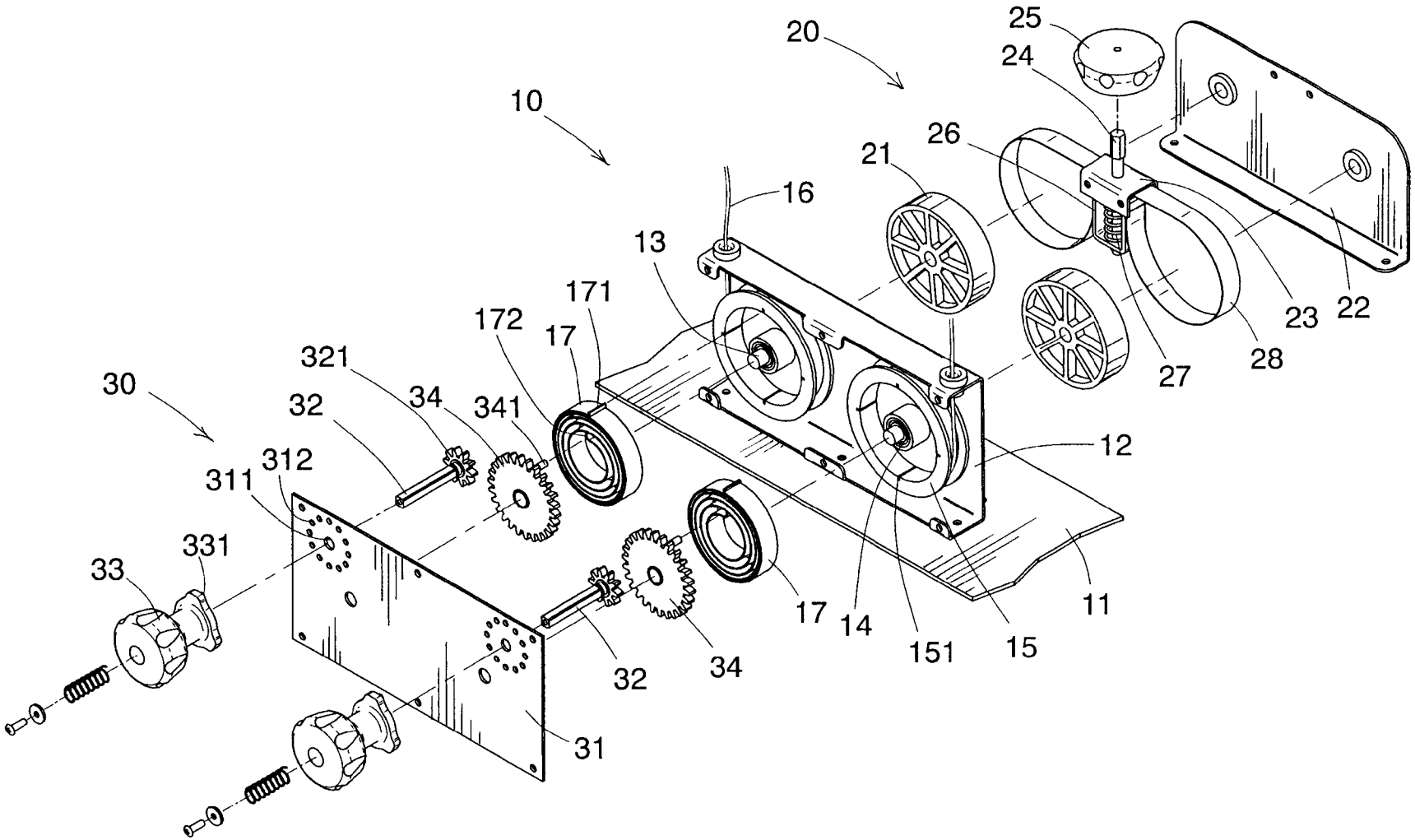
FIG. 1 is an exploded perspective view of a body exerciser having a reset adjustment function in accordance with a preferred embodiment of the present invention.
Figure 2:
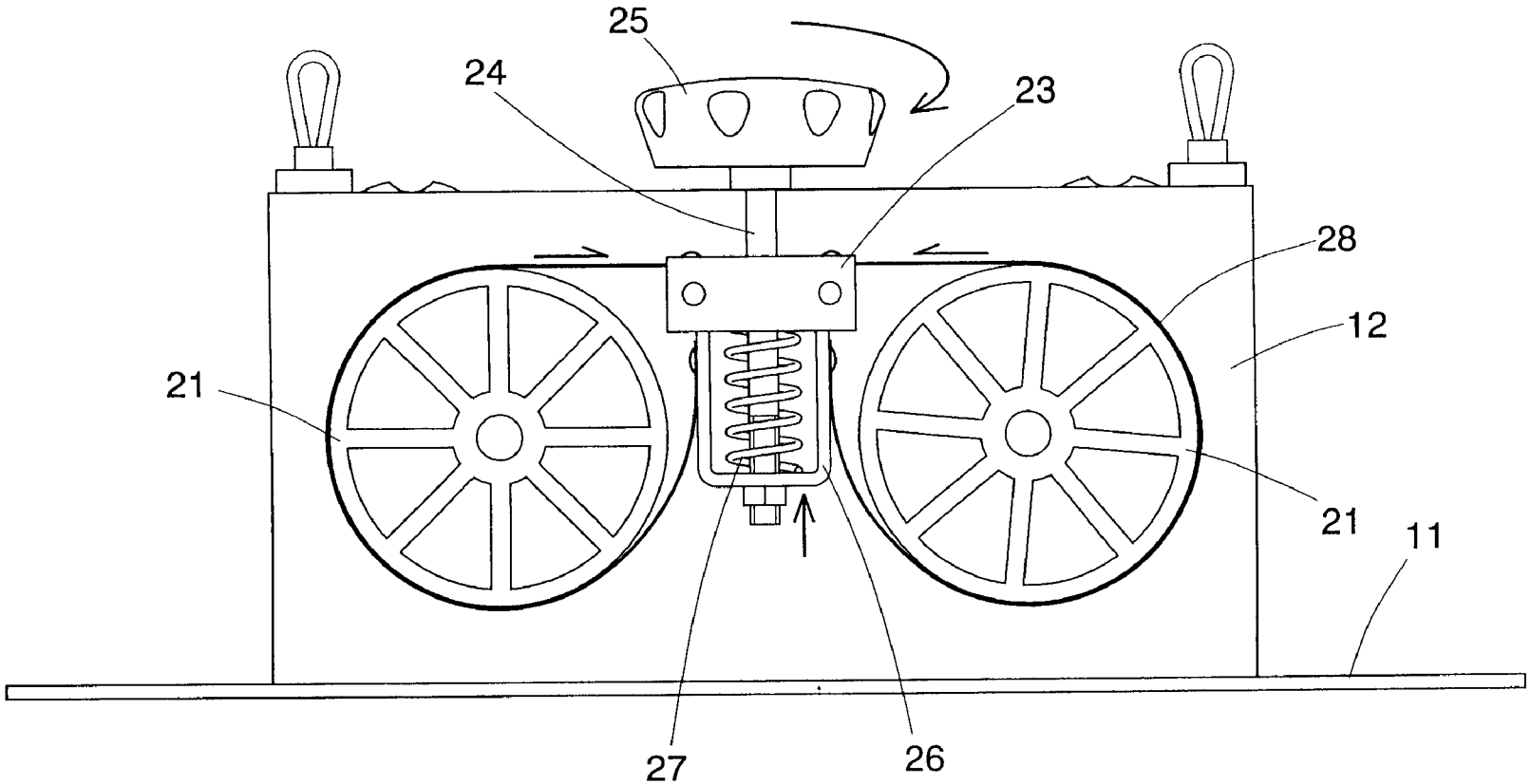
FIG. 2 is a partially cut-away front plan assembly view of the body exerciser having a reset adjustment function as shown in FIG. 1.
Figure 3:
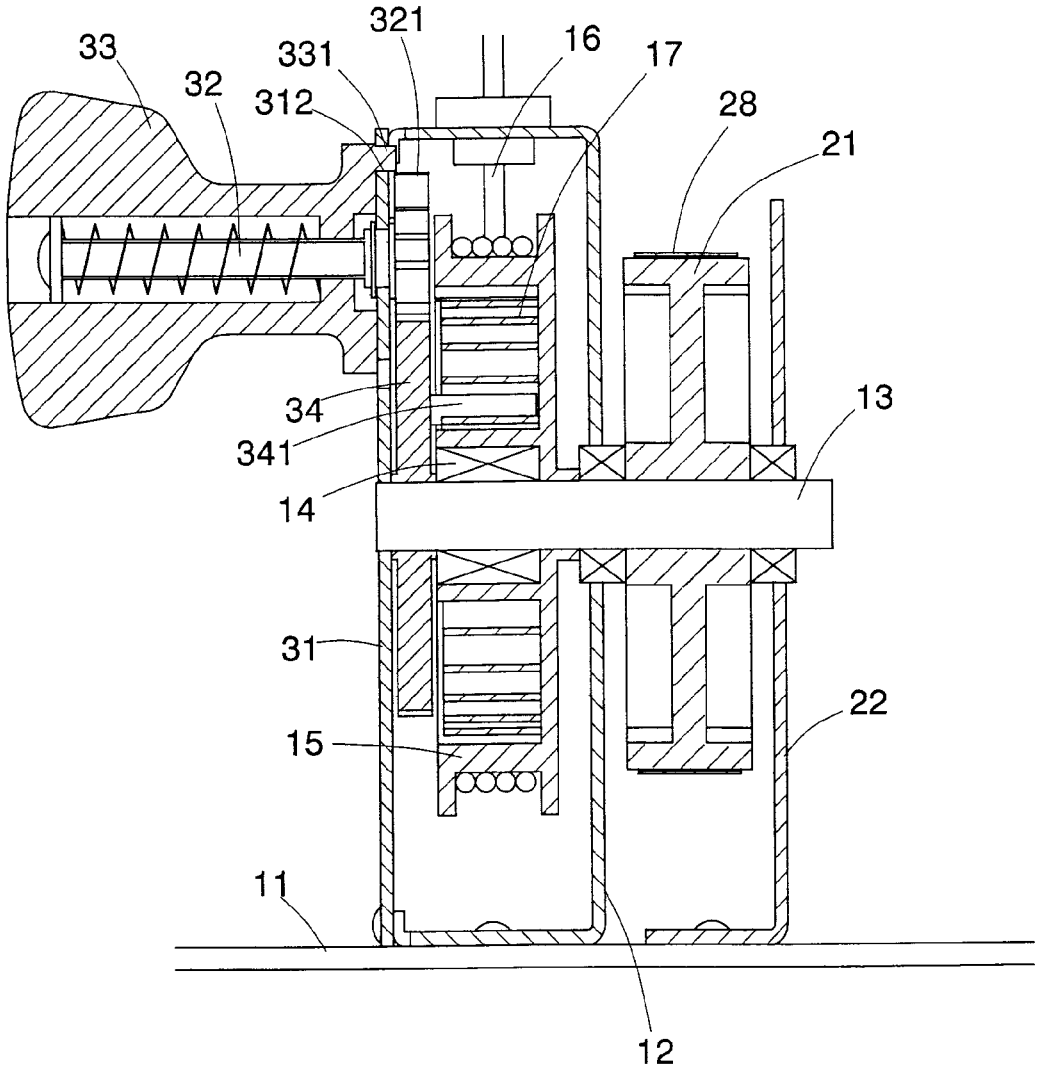
FIG. 3 is a side plan cross-sectional assembly view of the body exerciser having a reset adjustment function as shown in FIG. 1.

Referring to the drawings and initially to FIGS. 1–3, a body exerciser having a reset adjustment function in accordance with a preferred embodiment of the present invention comprises a main body structure 10, a gravity mechanism 20, and a restoring mechanism 30.

The main body structure 10 includes a flat plate 11, a casing 12 secured on a top face of the flat plate 11 and having a substantially U-shaped cross-section, two spindles 13 rotatably mounted on the casing 12, two single-direction bearings 14 each mounted on a respective one of the two spindles 13, two reels 15 each mounted on a respective one of the two single-direction bearings 14 and each having an inner wall formed with a plurality of slits 151, two pull cords 16 each having a first end mounted around an outer wall of a respective one of the two reels 15 and a second end extended outward from the casing 12, and two restoring springs 17 each mounted on the inner wall of a respective one of the two reels 15 and each having a fixing end 171 secured in one of the slits 151 of the respective reel 15. Each of the two reels 15 is located adjacent to a first side of the casing 12.

The gravity mechanism 20 includes two friction wheels 21 each secured on a respective one of the two spindles 13 of the main body structure 10 to rotate therewith, a first plate 22 secured on the top face of the flat plate 11 for supporting each of the two spindles 13, a substantially inverted U-shaped positioning frame 23 secured between the first plate 22 and the casing 12, an adjusting column 24 extended through a top face of the positioning frame 23, an adjusting knob 25 secured on a top of the adjusting column 24 for rotating 11 the adjusting column 24, a substantially U-shaped displacement frame 26 screwed on a bottom of the adjusting column 24, an elastic member 27 urged between the positioning frame 23 and the displacement frame 26, and two friction pieces 28 secured on the displacement frame 26 and enclosed around a periphery of a respective one of the two friction wheels 21. Preferably, each of the two friction pieces 28 has two free ends secured on one of two sides of the displacement frame 26 which may be used to adjust a friction load applied by each of the two friction pieces 28 on the respective friction wheel 21. Each of the two friction wheels 21 of the gravity mechanism 20 is located adjacent to a second side of the casing 12. Preferably, the elastic member 27 is a compression spring. In a normal state, the elastic member 27 has a first end rested on a bottom face of the positioning frame 23 and a second end rested on a top face of the displacement frame 26.

The restoring mechanism 30 includes a second plate 31 secured on a side edge of the casing 12, thereby closing each of the two reels 15. The second plate 31 of the restoring mechanism 30 is formed with two through holes 311 and a plurality of positioning holes 312 arranged around a periphery of each of the two through holes 311 in an annular manner. The restoring mechanism 30 further includes two drive shafts 32 each passed through a respective one of the two through holes 311 of the second plate 31, two rotation knobs 33 each secured on a first end of a respective one of the two drive shafts 32 for rotating it, two drive gears 321 each secured on and rotated by a second end of a respective one of the two drive shafts 32, and two driven gears 34 each mounted on a respective one of the two spindles 16 and each meshing with a respective one of the two drive gears 321. Each of the two driven gears 34 has one side provided with a positioning pin 341 which is secured on a free end 172 of a respective one of the two restoring springs 17. Each of the two rotation knobs 33 has one side provided with a plurality of protruding stubs 331 each positioned in a respective one of the positioning holes 312 of the second plate 31.

Thus, each of the two rotation knobs 33 may be rotated to rotate each of the two drive shafts 32 to rotate each of the two drive gears 321 to rotate each of the two driven gears 34 to move the positioning pin 341, so as to adjust each of the two restoring springs 17 and to drive and rotate each of the two reels 15, thereby scrolling and returning each of the two pull cords 16.

In adjustment, referring to FIGS. 1 and 2, the adjusting knob 25 of the gravity mechanism 20 may be rotated to rotate the adjusting column 24 which may drives the displacement frame 26 to move upward and to compress the elastic member 27, so that the two friction pieces 28 at the two sides of the displacement frame 26 may be displaced upward, so as to adjust the friction load applied by each of the two friction pieces 28 on the respective friction wheel 21, so that the two pull cords 16 may obtain different loads.

In operation, referring to FIGS. 1 and 3, the user's two hands may pull the two pull cords 16 upward, so as to drive each of the two reels 15 and each of the two friction wheels 21 to rotate. At this time, each of the two friction wheels 21 is subjected to the gravity load of each of the two friction pieces 28 of the gravity mechanism 20, and is subjected to the elastic compression of each of the two restoring springs 17, so that the user has to withstand the pulling loads of different extents, thereby achieving the purpose of exercising the user's hands. After the pulling force applied on the two pull cords 16 is removed, each of the two restoring springs 17 may be returned to the original position by its restoring action. In addition, by action of each of the two single-direction bearings 14, each of the two reels 15 is rotated in the reverse direction, and each of the two friction wheels 21 is not rotated. By rotation of each of the two reels 15 in the reverse direction, each of the two pull cords 16 may be scrolled on each of the two reels 15 and returned to the original position. Thus, the user may exercise his two hands by pulling and loosening the two pull cords 16 successively.

Figure 4:
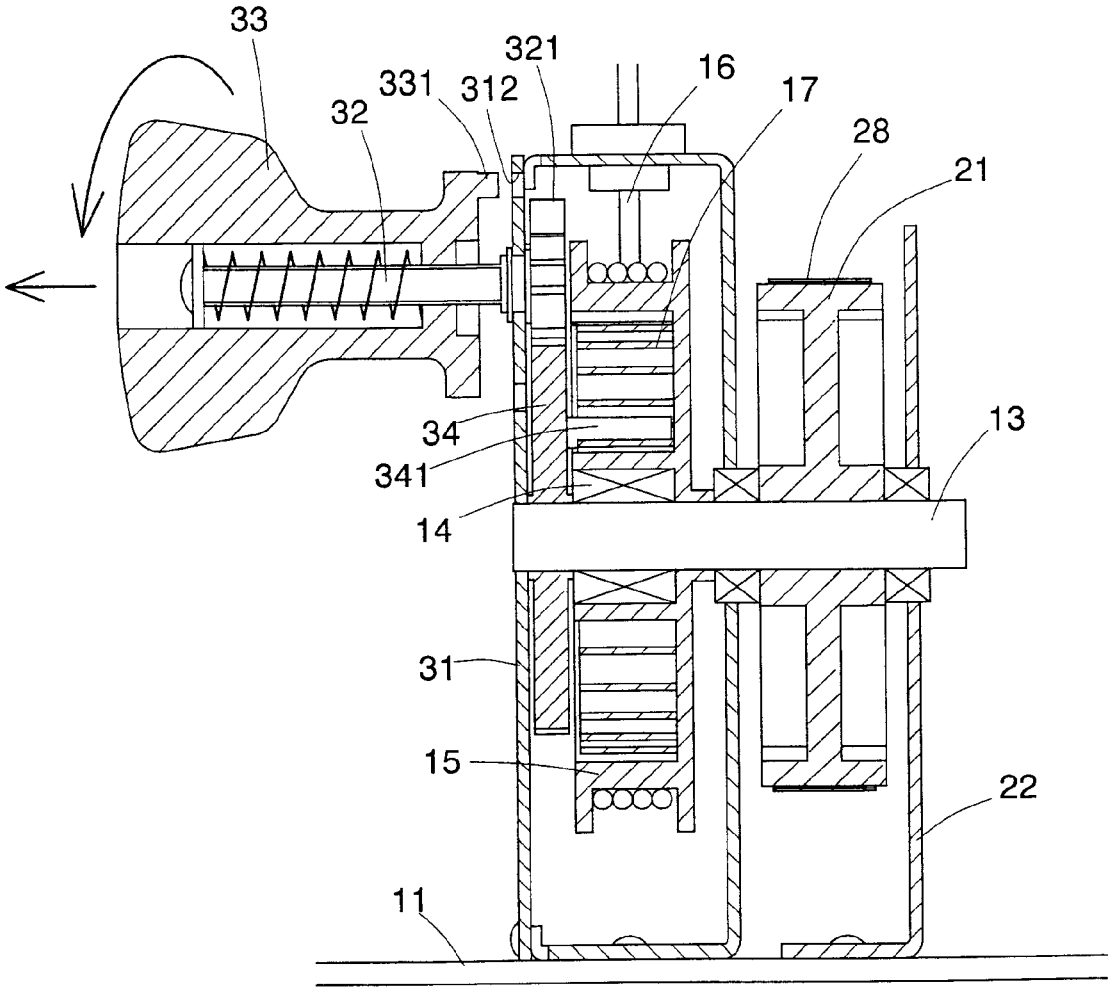
FIG. 4 is a schematic operational view of the body exerciser having a reset adjustment function as shown in FIG. 3 in use.
Figure 5:
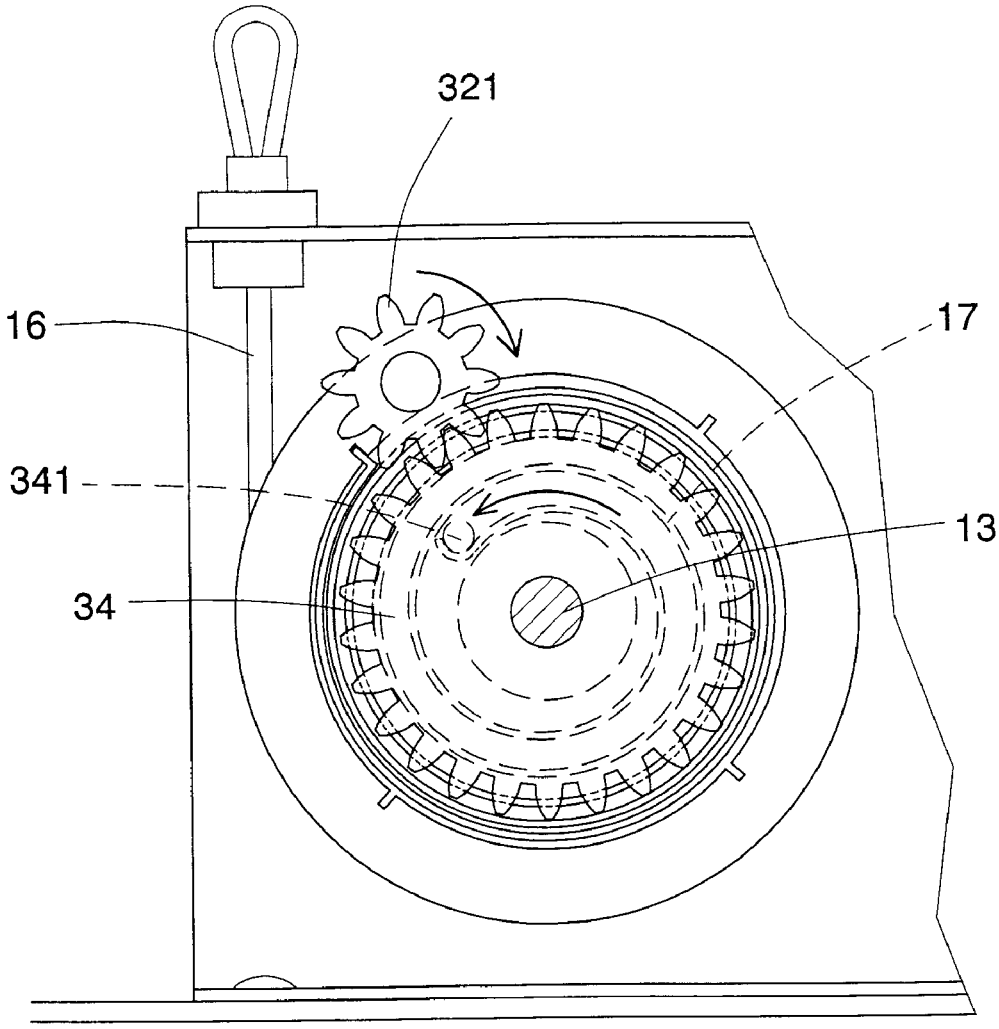
FIG. 5 is a partially cut-away front plan assembly view of the body exerciser having a reset adjustment function as shown in FIG. 1.
Figure 6:
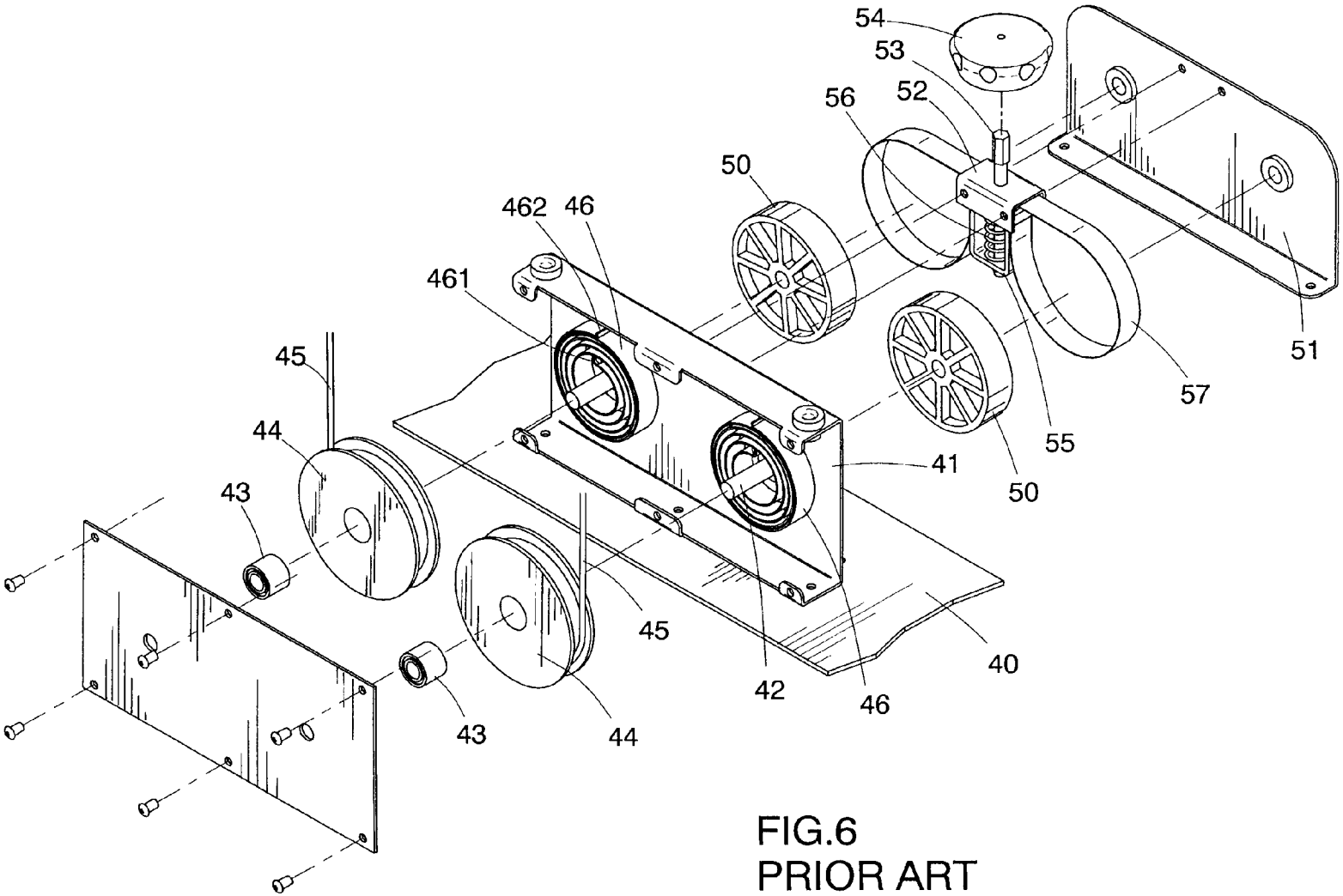
FIG.6 PRIOR ART
FIG. 6 is an exploded perspective view of a conventional body exerciser in accordance with the prior art.

Referring to FIGS. 4 and 5 with reference to FIG. 1, each of the two rotation knobs 33 of the restoring mechanism 30 may be pulled outward, so that the protruding stubs 331 of each of the two rotation knobs 33 may be detach from the positioning holes 312 of the second plate 31. Then, each of the two rotation knobs 33 may be rotated to rotate each of the two drive shafts 32 to rotate each of the two drive gears 321 to rotate each of the two driven gears 34 to move the positioning pin 341 to move the free end 172 of each of the two restoring springs 17, so that the fixing end 171 of each of the two restoring springs 17 may drive each of the reels 15 to rotate so as to scroll each of the two pull cords 16, thereby preventing the two pull cords 16 from becoming loosened.

Accordingly, the body exerciser in accordance with the present invention may be used to exercise the user's two hands, thereby achieving an exercising effect. In addition, each of the two pull cords 16 may be scrolled on each of the reels 15 actually, thereby preventing the two pull cords 16 from becoming loosened.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A body exerciser, comprising a main body structure, a gravity mechanism, and a restoring mechanism, wherein:

the main body structure includes a flat plate, a casing secured on a top face of the flat plate, two spindles rotatably mounted on the casing, two single-direction bearings each mounted on a respective one of the two spindles, two reels each mounted on a respective one of the two single-direction bearings and each having an inner wall formed with a plurality of slits, two pull cords each having a first end mounted around an outer wall of a respective one of the two reels and a second end extended outward from the casing, and two restoring springs each mounted on the inner wall of a respective one of the two reels and each having a fixing end secured in one of the slits of the respective reel;

the gravity mechanism includes two friction wheels each secured on a respective one of the two spindles of the main body structure to rotate therewith, a first plate secured on the top face of the flat plate for supporting each of the two spindles, a positioning frame secured between the first plate and the casing, an adjusting column extended through a top face of the positioning frame, an adjusting knob secured on a top of the adjusting column for rotating the adjusting column, a displacement frame screwed on a bottom of the adjusting column, an elastic member urged between the positioning frame and the displacement frame, and two friction pieces secured on the displacement frame and enclosed around a periphery of a respective one of the two friction wheels; and the restoring mechanism includes a second plate secured on a side edge of the casing, the second plate of the restoring mechanism is formed with two through holes and a plurality of positioning holes arranged around a periphery of each of the two through holes in an annular manner, the restoring mechanism further includes two drive shafts each passed through a respective one of the two through holes of the second plate, two rotation knobs each secured on a first end of a respective one of the two drive shafts for rotating it, two drive gears each secured on and rotated by a second end of a respective one of the two drive shafts, and two driven gears each mounted on a respective one of the two spindles and each meshing with a respective one of the two drive gears, each of the two driven gears has one side provided with a positioning pin which is secured on a free end of a respective one of the two restoring springs, each of the two rotation knobs has one side provided with a plurality of protruding stubs each positioned in a respective one of the positioning holes of the second plate.

2. The body exerciser in accordance with claim 1, wherein the casing has a substantially U-shaped cross-section.

3. The body exerciser in accordance with claim 1, wherein each of the two reels is located adjacent to a first side of the casing, and each of the two friction wheels of the gravity mechanism is located adjacent to a second side of the casing.

4. The body exerciser in accordance with claim 1, wherein the positioning frame is substantially inverted U-shaped.

5. The body exerciser in accordance with claim 1, wherein the displacement frame is substantially U-shaped.

6. The body exerciser in accordance with claim 1, wherein the elastic member is a compression spring.

7. The body exerciser in accordance with claim 1, wherein the elastic member has a first end rested on a bottom face of the positioning frame and a second end rested on a top face of the displacement frame.

8. The body exerciser in accordance with claim 1, wherein each of the two friction pieces has two free ends secured on one of two sides of the displacement frame.

* * * * *